US007908685B2

(12) United States Patent
Ericson

(10) Patent No.: US 7,908,685 B2
(45) Date of Patent: Mar. 22, 2011

(54) WATER TRAP FOR SANITARY APPLIANCES

(75) Inventor: Kurt Sture Birger Ericson, Schilde (BE)

(73) Assignee: Studor S.A., Luxembourg (LU)

( * ) Notice: Subject to any disclaimer, the term of this patent is extended or adjusted under 35 U.S.C. 154(b) by 849 days.

(21) Appl. No.: 11/722,792

(22) PCT Filed: Dec. 21, 2005

(86) PCT No.: PCT/BE2005/000186

§ 371 (c)(1),
(2), (4) Date: Aug. 13, 2007

(87) PCT Pub. No.: WO2006/066366

PCT Pub. Date: Jun. 29, 2006

(65) Prior Publication Data

US 2008/0222798 A1 Sep. 18, 2008

(30) Foreign Application Priority Data

Dec. 24, 2004 (GB) ..... 0428401.4

(51) Int. Cl.
*E03C 1/12* (2006.01)

(52) U.S. Cl. ..... 4/679; 4/681; 4/DIG. 16

(58) Field of Classification Search ..... 4/679–683, 4/688, DIG. 16; 137/247.39, 362
See application file for complete search history.

(56) References Cited

U.S. PATENT DOCUMENTS

| | | | | | |
|---|---|---|---|---|---|
| 202,250 | A | * | 4/1878 | Dunn et al. | 137/247.35 |
| 605,202 | A | * | 6/1898 | Mullenhoff | 137/247.35 |
| 3,605,132 | A | * | 9/1971 | Lineback | 4/211 |
| 3,766,575 | A | | 10/1973 | Grengs | |
| 4,212,314 | A | * | 7/1980 | Ericson | 137/362 |
| 4,524,795 | A | | 6/1985 | Ericson et al. | |
| 4,545,398 | A | | 10/1985 | van Olst | |
| 5,159,724 | A | * | 11/1992 | Vosper | 4/679 |

FOREIGN PATENT DOCUMENTS

| | | |
|---|---|---|
| EP | 1 059 391 A2 | 12/2000 |
| GB | 2 397 357 A | 7/2004 |
| JP | 2004-197479 | 7/2004 |

* cited by examiner

*Primary Examiner* — Khoa D Huynh
(74) *Attorney, Agent, or Firm* — Hovey Williams LLP

(57) ABSTRACT

A water trap for sanitary appliances of the kind having an inlet (5) and an outlet (12) and including a housing (1) with an upper portion (4) provided with the inlet opening (5) adapted to receive the outlet pipe (6) of the sanitary appliance, a central portion (3) adapted to be connected to the upper portion (4), provided with a cylindrical passing through space (10), the outlet opening (12) connected to an evacuation pipe (13) situated in a lower extension of the central portion (3) and a valve housing (11), situated in the upper part, incorporating an air admittance valve (8) located above the outlet opening (12) and leaving between its lower part and the upper surface of the outlet opening (12) an air admittance area (17); a lower portion (2) connected to the central portion (3) and in which the main part of the water trap or seal is formed by use of a separation wall (20) extending from the central portion (3) into the lower portion (2).

13 Claims, 4 Drawing Sheets

FIG 1A
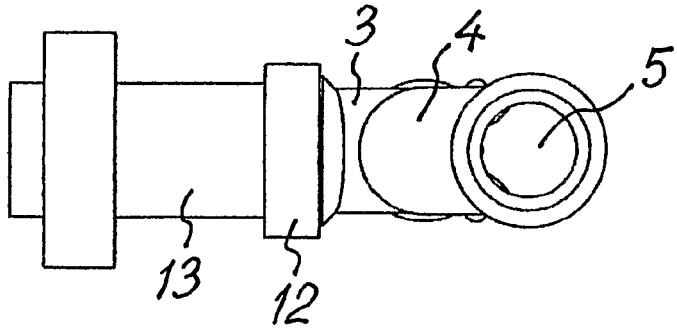
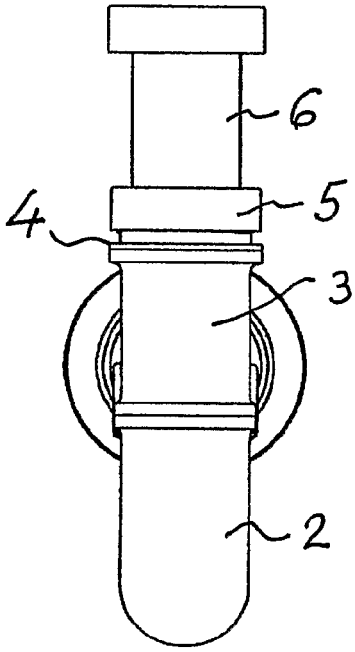
FIG 1C
FIG 1
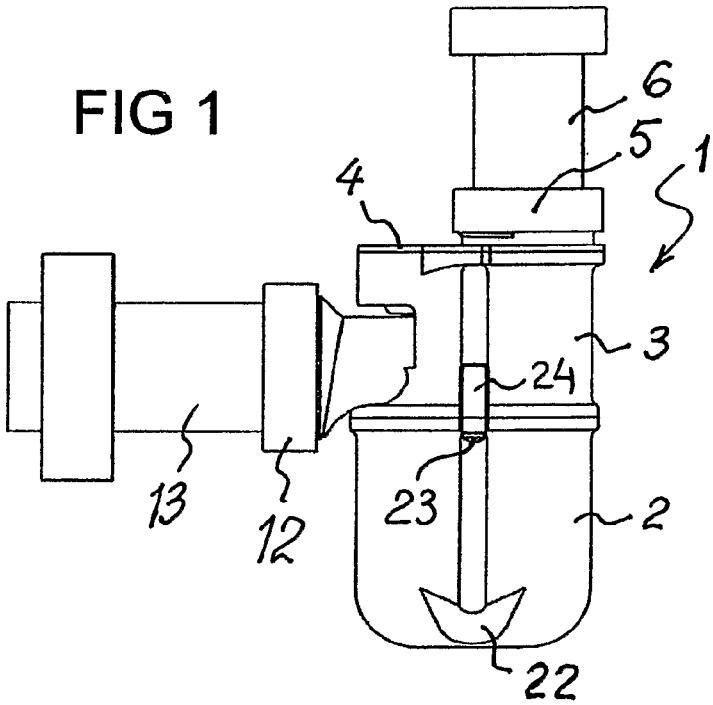
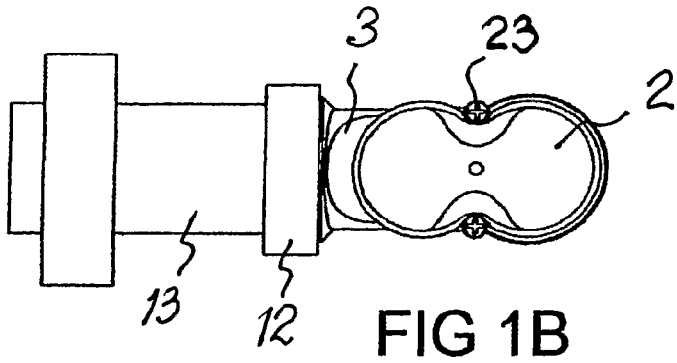
FIG 1B

FIG 2
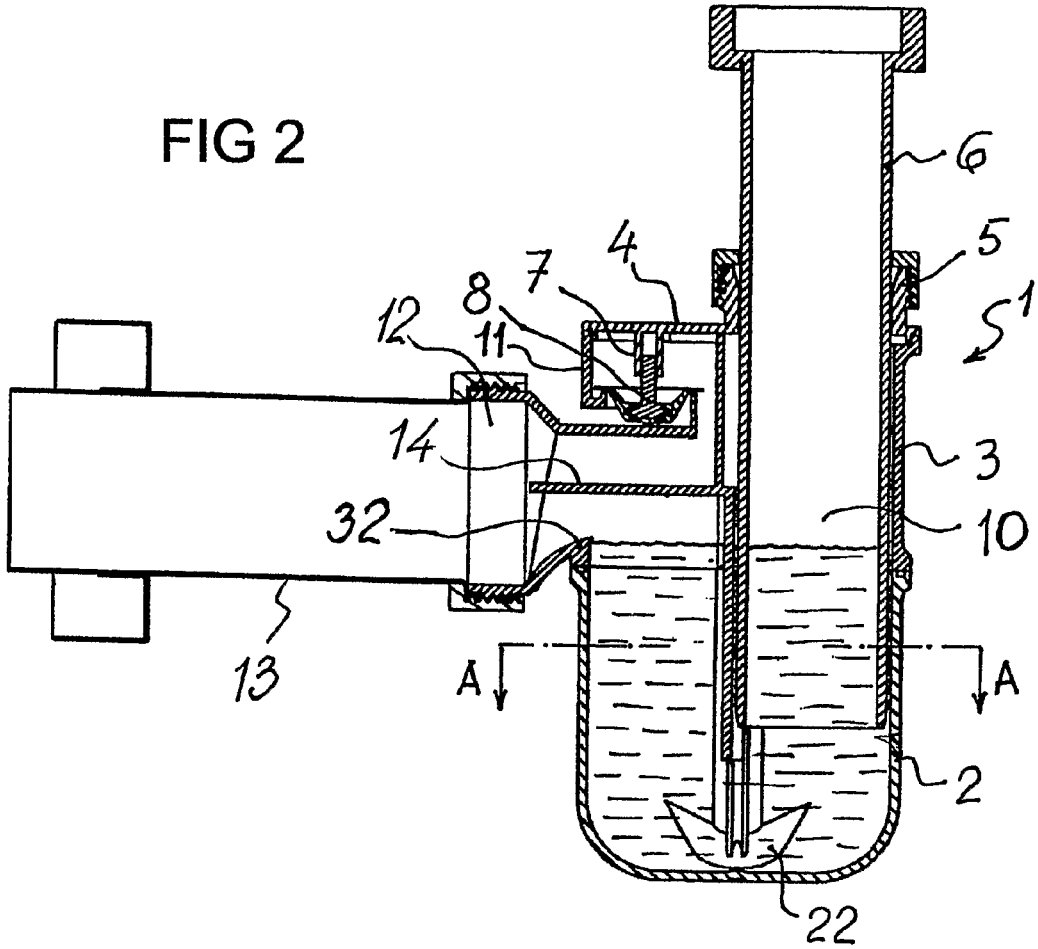
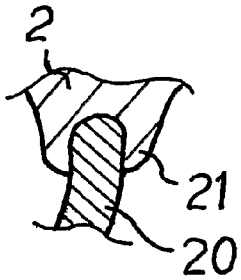
FIG 2B
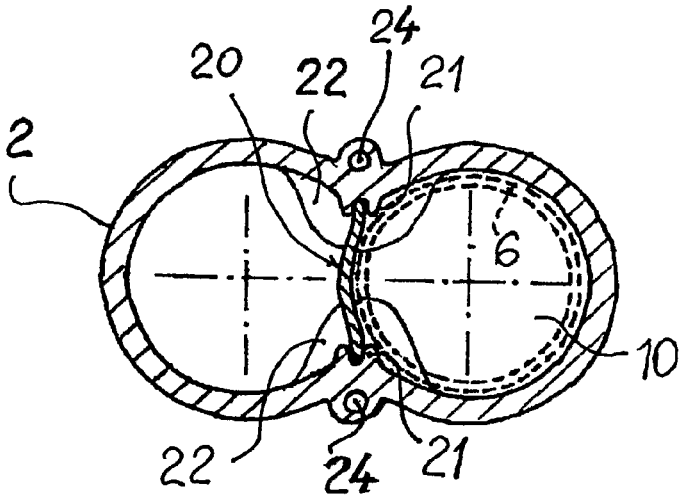
FIG 2A

FIG 6
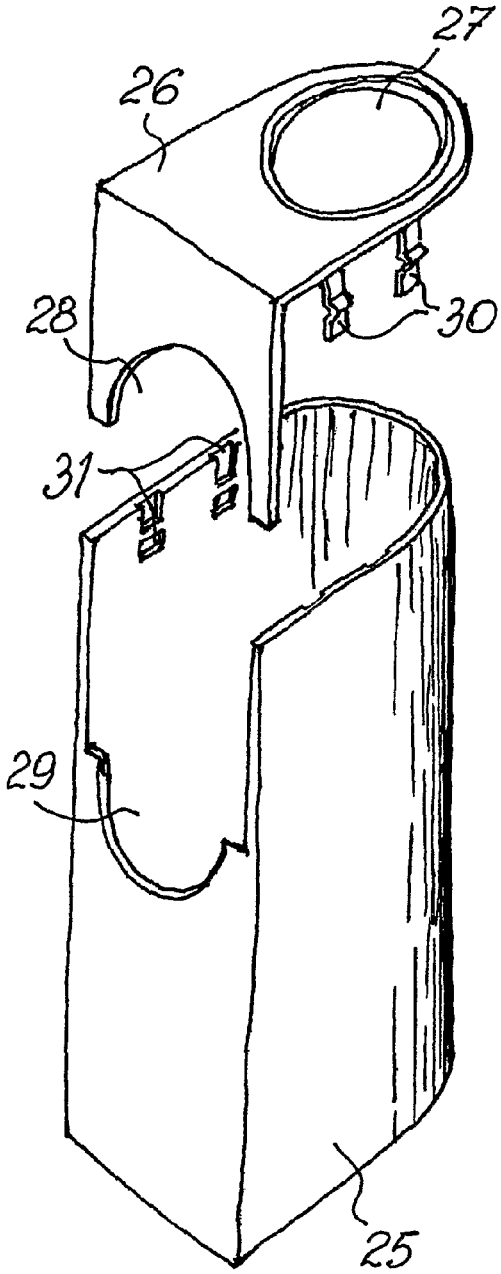
FIG 5
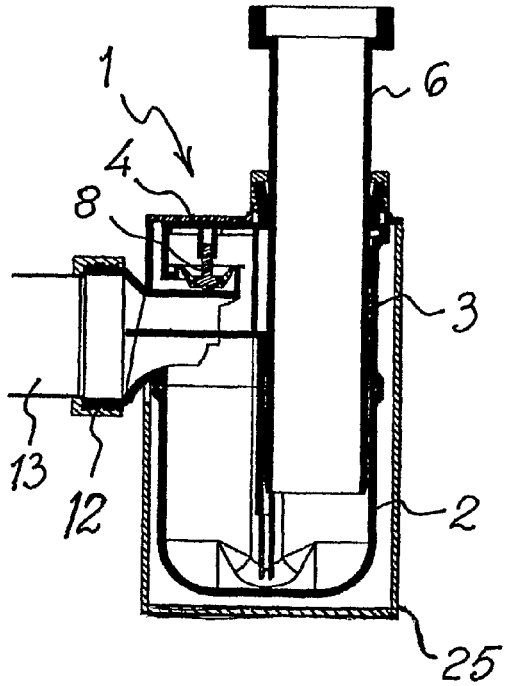
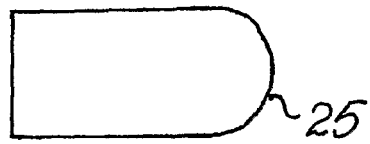
FIG 7
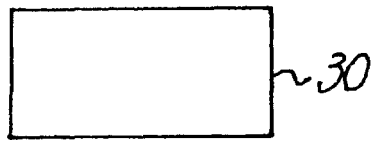
FIG 8

WATER TRAP FOR SANITARY APPLIANCES

This is a national stage application of International Application PCT/BE2005/000186 filed 21 Dec. 2005, claiming priority from Great Britain application no. 0428401.4 filed 24 Dec. 2004, the disclosures of which are incorporated herein by reference.

BACKGROUND OF THE INVENTION

1. Field of the Invention

This invention relates to water or liquid sealing traps such as used to connect the waste water outlet of a wash-basin, sink or the like to a waste water drainage system.

2. Description of the Prior Art

It is generally known that a permanent water seal is required in the water trap to assure the normal function of a waste water outlet installation and to prevent contaminated air from the sewer from contacting the surrounding atmosphere.

A water trap of this kind may be U shaped with one leg connected to a sanitary appliance, such as a wash basin or the like, and the other leg connected to the waste water system. Another embodiment of the water trap may be in the shape of a bottle-like container, in the centre of which extends a vertical pipe connected to the water basin and having an outlet for connection with the waste water pipe.

Existing water traps of the two kinds have been provided with an air admittance valve in order to eliminate negative air pressure which may occur in the drainage system, especially when flushing down an amount of waste water through the vertical parts of the waste water pipes. In such cases air suction may be such that the water contained in the water traps is sucked away, breaking the water seal.

A U-shaped water trap provided with an air admittance valve has already been disclosed in U.S. Pat. No. 605,202 which is related to a trap for sinks, the outlet pipe of which being provided with a valve that seats itself by gravity. This air admittance valve is extending upwards from the outlet pipe which diminishes the available space around the water trap and which is positioned in such a way that it may be accidentally tampered and damaged preventing the normal working of the valve.

The patent documents GB 856.064 and GB 1.220.982 also refer to water or liquid sealing traps provided with air admittance valves. In the first document the valve is either applied to the outlet leg of a U-shaped version of the trap and the inlet leg is connected to a wash basin or the like or to the cylindrical head of the container in a bottle shaped version. In this case the non return air valve is fitted on the side opposite the outlet pipe to the sewer. In both cases the position of the valve is an obstacle to easy fitting of the water trap in a generally confined spaced.

Document GB 1.397.705 discloses a bottle shaped trap with a non return valve provided inside the water trap body and more precisely in a separation wall between the inlet area and the outlet pipe above the static liquid level. The port by-passing the liquid seal and the valve includes means whereby it is normally held closed but opens upon suction in the outlet pipe to admit air from the inlet area to break the suction. In this case the valve is not protruding the outer configuration of the water trap but is situated in an area where it is constantly subject to (waste) humid atmosphere and sediment of waste water passing through the water trap, causing clogging of the valve membrane.

Finally, document GB 2 005 749 discloses a water trap of the bottle shaped version including an annular air admittance valve situated in the upper portion of the container. In this case the valve is completely separate from the waste water flow, but the overall dimensions of the container and valve is rather important, especially in confined spaces.

SUMMARY OF THE INVENTION

The present invention provides means eliminating the drawbacks outlined here above whereby the water trap has minimum overall dimensions while maintaining or even improving the water flow capacity and lowering the required maintenance frequency of the water trap.

The present invention further allows for the water trap embodiment to be covered by a suitable jacket adapted to the design and materials of the sanitary appliance.

According to the present invention, the water trap is configured and provided with means which include a housing having an upper portion provided with an inlet opening adapted to receive the outlet pipe of a sanitary appliance. A central portion is provided which is adapted to be connected to the upper portion, and is provided with a cylindrical passing through space or passage. The outlet opening is adapted to be connected to an evacuation pipe of a drainage system situated in a lower extension of the central portion, and to a valve housing. The valve housing is situated in the upper part, and incorporates an air admittance valve. The housing also includes a lower portion connected to the central portion. The air admittance valve is situated at one side of the upper part of the central portion adjacent to the cylindrical space and is located above the outlet opening, leaving an air admittance area located between the lower part of the air admittance valve and the upper surface of the outlet opening.

BRIEF DESCRIPTION OF THE DRAWINGS

An embodiment of a water trap according to the invention will be described hereafter, by way of an example only, with reference to the accompanying drawings, in which:

FIG. 1 is side view of a water trap according to the invention;

FIGS. 1A, 1B and 1C are respectively, a top view, a bottom view and a front view of the water trap according to FIG. 1.

FIG. 2 is a vertical cross section view along the centre of the water trap represented in the FIG. 1;

FIG. 2A is an enlarged horizontal cross section view about the line A-A in FIG. 2;

FIG. 2B is a detailed view of the assembling between a separation wall extending from the central portion and the guiding/tightening means of the lower portion;

FIG. 5 is a vertical cross section view of a water trap according to the invention provided with a jacket;

FIG. 6 is an exploded perspective view of the jacket according to FIG. 5;

FIGS. 7 and 8 are bottom views of possible shapes of the jacket according to the FIG. 5.

DESCRIPTION OF THE PREFERRED EMBODIMENTS

In FIG. 1, a water trap is shown, of a general U-shaped kind, which consists of an housing 1, including a lower portion 2 or bowl in which the water trap can be formed, a central portion 3, adapted to be connected to the lower portion 2 and an upper closing portion 4.

Figure 3:
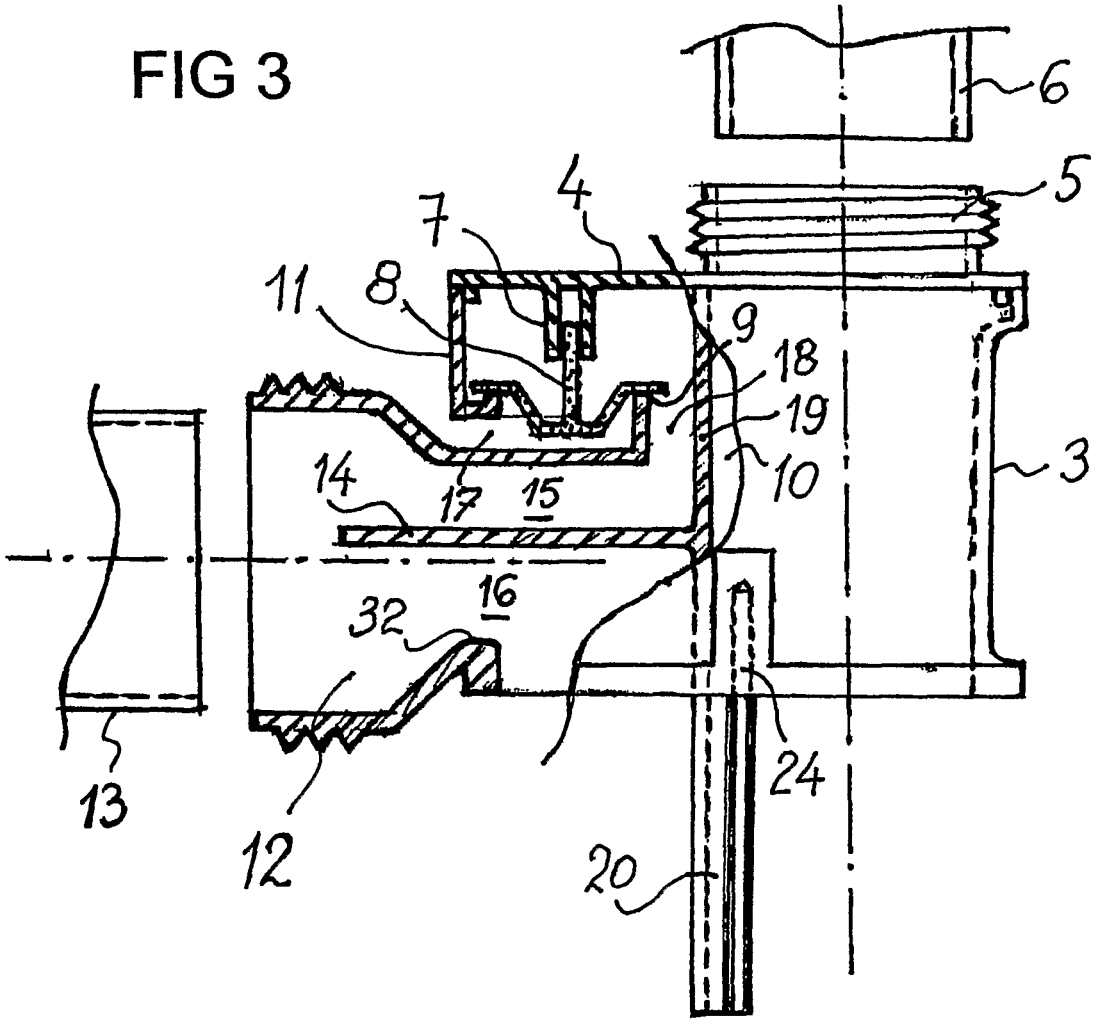
FIG. 3 is a partially cut out side view of the central portion of the water trap according to FIG. 1.
Figure 4:
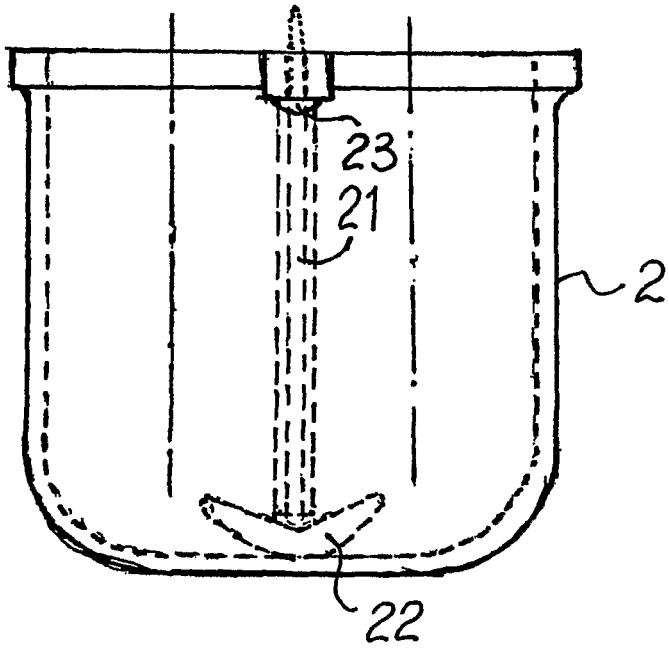
FIG. 4 is a side view of the lower portion of the water trap according to FIG. 1.

The upper portion 4 is provided with an inlet opening 5 adapted to receive the outlet pipe 6 of a water basin or the like. As can be seen in FIGS. 2 and 3, adjacent to the inlet opening, the inner side of the upper portion 4 is provided with guiding means 7 arranged to co-operate with a normally closed membrane 8 of an air inlet valve which is advantageously incorporated to assure efficient function of the water trap.

As shown in FIG. 1A, the shape of the upper portion 4 of the water trap is oblong, the smaller dimension of which corresponds approximately to the diameter of the outlet pipe 6 and the larger dimension corresponds with about twice said diameter. One major half portion of the upper portion 4 represents the opening 5 and the adjacent portion covers mainly a housing 11 with the membrane 8 of the air admittance valve. Said portion also contains downwardly extending guiding means co-operating with the membrane 8.

The shape of the membrane 8 will advantageously be cup or U shaped in order to reduce the total height of the housing 1 and to leave sufficient space for the guiding means 7.

The central portion 3 of the water trap has an horizontal section which corresponds with the shape of the upper closing portion 4. During assembling of the components of the water trap, the closing portion 4 is fixed to the upper side of the central portion 3.

Accordingly, the central portion 3 is provided with a cylindrical space 10, extending vertically and adapted to receive the outlet pipe 6 of the water basin, or the like, which is passing through the inlet opening 5 of the upper portion 4, as shown in FIGS. 2 and 3.

Adjacent to the cylindrical space 10, the central portion 3 is provided, in an upper part, with a valve housing 11 constituting an air admittance valve and, in a lower part, with an outlet opening 12 situated in a lateral extension from the central portion 3, said outlet opening 12 being located underneath the housing 11 of the air admittance valve.

The valve housing 11 is built in such a way that it forms an air admittance area 17 between its lower part and the upper surface of the outlet opening 12. Said lower part forms a valve seat 9 on which rests the membrane 8 in closed position, by gravity only, and which leaves a space 18 between the seat 9 and a vertical wall 19 defining the cylindrical space 10 of the central portion 3.

The outlet opening 12 is adapted to co-operate with a pipe 13 connected to the drainage system and is provided about its centre with an horizontal partition wall 14 which is situated about the centre line of the opening 12 and dividing said opening into completely separated conduits, one upper conduit 15, above the partition wall, to allow air inlet flow from the air admittance valve when negative pressure occurs in the drainage system and one lower conduit 16, beneath the partition wall, to allow the waste water to be evacuated into the pipe 13 of the drainage system.

The air inlet flow through the upper conduit 15 emerges into the outlet opening 12 by means of a venturi shaped upper wall of the opening 12 improving the air flow capacity. The waste water flow through the lower conduit 16 emerges into the outlet opening 12 by means of a venturi shaped lower wall of the opening 12 improving the water flow capacity.

The conduit 16 is provided, in its lower part, with a restriction in the shape of an overflow rim 32 towards the evacuation pipe 13. The level of said overflow rim 32 is situated above the lowest level of the evacuation pipe 13.

In case of negative pressure in the drainage system, the membrane 8 will automatically lift from its seat 9 and atmospheric air will be able to flow into the water trap via the space 18 and the upper conduit 15 towards the evacuation pipe 13 and the drainage system.

According to the invention, the vertical wall 19 of the central portion 3 extends downwards to form a separation wall 20 adapted to co-operate with vertical guiding and tightening slots 21 provided laterally on both inner sides of the lower portion 2 (FIG. 2A).

Said lower portion 2 has the outer shape of an oblong cup formed by two intersecting cylindrical walls the intersecting parts being left out to create a space provided for the separation wall of the central portion 3. The guiding and tightening slots 21 are provided in the inner lateral intersection area of said cylindrical walls and the separation wall 20 leaves sufficient space between its lower part and the bottom of the lower portion 2 to allow full capacity of the waste water flow to be evacuated.

The actual water trap seal is formed between the upper level of the rim 32 and the lower extremity of the separation wall 20. The distance between those levels constitutes the height of the water trap seal which can be adapted to existing standards relating to the height of the water trap, the separation wall 20 being always situated below the water level of the water trap.

In fact the water trap according to the present invention has not a U shaped body but the U shaped pattern of the water seal itself is only obtained by the cylindrical intersecting side walls of the lower portion 2 in combination with the separation wall 20 extending downwards from the central portion 3. Accordingly, it is important that the lateral side walls of said separation wall 20 co-operate with the guiding means 21 in such a way that it becomes a water tight connection (see FIG. 2B).

In order to improve the working of, and to avoid frequent maintenance of, the water trap, the bottom of the lower portion 2 is provided with deflection walls 22 restricting the water flow in the bottom of the lower part 2 in order to increase the velocity of the water flow and to evacuate waste deposit in the water trap.

The lower portion 2 will be advantageously fixed to the central portion 3 by any suitable means. In the embodiment shown on the enclosed drawings 1, 2A, 3 and 4, the lower portion 2 is fixed to the central portion by means of screws 23 adapted to fit into holes 24 of the central portion 3. According to the shown embodiment, the fixing means or screws 23 are situated in the central area of the intersecting cylindrical walls in order not to protrude beyond the outer lateral surface of the water trap housing 1

The contact surfaces between the lower surface of the central portion 3 and the upper surface of the lower portion 2 will advantageously be provided with sealing means such as a flange joint or an O-ring to avoid leakage between the two parts.

When evacuating waste water from the water basin, the water will flow through the outlet pipe 6 directly into the lower portion 2 of the water trap. The waste water will flow via the bottom of the lower portion 2 and the deflection walls 22 and between the partition wall 14 and the overflow rim 32 towards the evacuation pipe 13.

Upon stopping of the waste water flow, a water trap will be built up in the lower portion 2 of the water trap according to the invention and partly in the central portion 3 up to the level of the overflow rim 32. In case of negative pressure in the drainage system, the membrane 8 of the air admittance valve will lift up temporarily and allow air flow to enter the system via the space 18 and the upper conduit 15 above the partition wall 14 towards the evacuation pipe 13.

An advantage of the water trap, according to the invention, is in the fact that the outer configuration is particularly suitable to be covered by a jacket 25 such as the one illustrated in FIGS. 5 to 8.

Said jacket 25 can be maintained onto the water trap 1 by means of a closing member 26 adapted to be installed in the upper region of the water trap. For this purpose this member 26 is provided in a horizontal part with an opening 27 suitable to match with the inlet opening 5 of the water trap 1 and in a vertical part with a half cylindrical opening 28 suitable to match the central portion 3 at the rear part of the outlet opening 12.

The jacket 25 itself covers almost the entire embodiment of the water trap 1 and is provided on the backside with an opening and an half cylindrical opening 29 suitable to match the central portion 3 at the rear part of the outlet opening 12.

Different means can be proposed to maintain the jacket and the closing member together. In the embodiment shown in FIG. 6, such means could be flexible members 30 of the closing member 26 engaging corresponding apertures 31 in the jacket 25.

As shown on FIGS. 6 and 7, the jacket 25 has a substantial rectangular horizontal cross section with a cylindrical shaped front portion in order to lose a minimum of available space.

The jacket could also have a clear rectangular horizontal cross section such as shown in the bottom view of FIG. 8.

The main advantage of the present invention is to provide a water trap device, provided with an air admittance valve, with minimum overall dimensions which is most appreciated in general confined or restricted spaces.

Another advantage of the present invention is the fact that, due to said minimum overall dimensions, it becomes possible to provide the water trap with a suitable cover in the shape of a jacket adapted to match with the design, material or colour of the sanitary appliance to which it is connected.

Despite the fact that only one embodiment of the water trap structure, according to the present invention, has been described in detail here above, various changes and modifications may be made without departing from the scope of the invention.

LEGENDS OF THE REFERENCES ON THE FIGURES

1. housing of the water trap
2. lower portion
3. central portion
4. upper portion
5. inlet opening of the water trap
6. outlet pipe of the sanitary appliance
7. guiding means of the air admittance valve
8. membrane
9. seat of the valve
10. cylindrical space
11. valve housing
12. outlet opening of the water trap
13. evacuation pipe
14. partition wall
15. upper conduct of the outlet opening
16. lower conduct of the outlet opening
17. air admittance area
18. space between air admittance valve and cylindrical space 10
19. vertical wall
20. separation wall
21. guiding slots
22. deflection walls
23. screws
24. holes
25. jacket
26. closing member
27. opening
28. half cylindrical opening of closing member
29. half cylindrical opening of the jacket
30. flexible members
31. apertures
32. overflow rim

The invention claimed is:

1. A generally U-shaped water trap for sanitary appliances, said water trap having an inlet opening and an outlet opening and comprising a housing having:

an upper portion provided with the inlet opening adapted to receive an outlet pipe of the sanitary appliance;

a central portion adapted to be connected to the upper portion provided with a cylindrical passing through space, the outlet opening being situated in a lower extension of the central portion and adapted to be connected to an evacuation pipe of a drainage system, the central portion further including a valve housing situated in an upper part of the central portion and incorporating an air admittance valve;

a lower portion in which the water trap is formed and which is connected to the central portion, the lower portion having a part thereof of an outer shape of an oblong cup formed by two intersecting cylindrical walls but wherein parts of the cylindrical walls which normally intersect are left out to create an open intersection area; and a separation wall extending downwardly from a lower surface of the central portion into the lower portion for forming at least a part of a U-shaped seal in the water trap, the separation wall being positioned in said intersection area, the separation wall having a lower part and being sized to leave an area between the bottom of the part of the lower portion with the outer shape of an oblong cup and the lower part of the separation wall sufficient to allow waste water flow to be evacuated through the outlet opening, the U-shaped seal being formed by water present in the lower portion between an upper level of an overflow rim of the outlet opening and the lower part of the separation wall, wherein the outlet opening of the central portion is provided an horizontal partition wall which is situated about the center line of the outlet opening and divides said outlet opening into separate conduits, said separate conduits comprising one upper conduit above the partition wall for allowing inlet air to flow from the air admittance valve and one lower waste water conduit situated beneath the partition wall for allowing the waste water flow to be evacuated through the outlet opening towards the drainage system.

2. A water trap according to claim 1, in which the inlet airflow through the space and the upper conduit emerges into the outlet opening by means of a venturi shaped upper wall of the opening.

3. A water trap according to claim 1, in which the waste water flow through the lower conduit emerges into the outlet opening by means of a venturi shaped lower wall of the opening.

4. A water trap according to claim 1, in which the outlet opening of the central portion is provided with a lower wall forming the overflow rim towards the evacuation pipe, the level of said overflow rim being situated about the lowest level of the evacuation pipe.

5. A water trap according to claim 1, wherein the lower part of the valve housing forms a valve seat on which rests a membrane in a closed position and which leaves a space for an air inlet between the seat and a vertical wall defining the cylindrical passing through space of the central portion.

6. A water trap according to claim 1, wherein the air admittance valve is situated at one side of the upper part of the central portion adjacent to the cylindrical passing through space and is located above the outlet opening, leaving between its lower part and the upper surface of the outlet opening an air admittance area.

7. A water trap according to claim 1, wherein the cylindrical passing through space of the central portion is formed in its center by a vertical wall which extends downwardly beyond the lower surface of the central portion to form a separation wall adapted to co-operate with the lower portion.

8. A water trap according to claim 7, wherein the separation wall extends downwards from the central portion and wherein is adapted to co-operate with guiding and tightening slots provided on both lateral sides of the lower portion.

9. A water trap according to claim 1, wherein the lower portion has an outer shape formed by two intersecting cylindrical walls leaving between them a space in which a separation wall from the central portion extends, one of the walls being adapted to receive the outlet pipe of the sanitary appliance, the outlet pipe being vertically extending.

10. A water trap according to claim 1, wherein the bottom of the lower portion is provided with deflecting side walls which project from sides of said cup-shaped portion restricting the passage in said lower portion in order to increase the velocity of the water flow through said passage and to evacuate waste deposit in the water trap.

11. A water trap according to claim 1, wherein the overall outer shape of the housing is covered with a jacket in which openings are provided to match with the inlet opening and the outlet opening and which is maintained on the water trap by means of a closing member adapted to be installed in the upper region of the water trap housing.

12. A water trap according to claim 1, wherein the lower part of the valve housing forms a valve seat on which rests a membrane in a closed position and which leaves a space for an air inlet between the seat and a vertical wall defining the cylindrical passing through space of the central portion.

13. A water trap according to claim 5, wherein the air admittance valve is situated at one side of the upper part of the central portion adjacent to the cylindrical passing through space and is located above the outlet opening, leaving between its lower part and the upper surface of the outlet opening an air admittance area.

* * * * *